US009436161B2

(12) United States Patent
Kadmiri et al.

(10) Patent No.: US 9,436,161 B2
(45) Date of Patent: Sep. 6, 2016

(54) MUSICAL WATCH CASE WITH IMPROVED ACOUSTIC PERFORMANCE

(71) Applicant: Montres Breguet SA, L'Abbaye (CH)

(72) Inventors: Younes Kadmiri, Morre (FR); Davide Sarchi, Renens (CH); Polychronis Nakis Karapatis, Premier (CH)

(73) Assignee: Montres Breguet S.A., L'Abbaye (CH)

( * ) Notice: Subject to any disclaimer, the term of this patent is extended or adjusted under 35 U.S.C. 154(b) by 0 days.

(21) Appl. No.: 14/863,617

(22) Filed: Sep. 24, 2015

(65) Prior Publication Data

US 2016/0098013 A1 Apr. 7, 2016

(30) Foreign Application Priority Data

Oct. 1, 2014 (EP) ..... 14187235

(51) Int. Cl.

| | |
|---|---|
| ***G04B 21/00*** | (2006.01) |
| ***G04B 21/08*** | (2006.01) |
| ***G04B 23/00*** | (2006.01) |
| ***G04B 23/02*** | (2006.01) |
| ***G04B 37/00*** | (2006.01) |
| ***G04B 19/28*** | (2006.01) |
| ***G04B 39/00*** | (2006.01) |

(52) U.S. Cl.

CPC ..... *G04B 23/005* (2013.01); *G04B 19/283* (2013.01); *G04B 21/00* (2013.01); *G04B 21/08* (2013.01); *G04B 23/028* (2013.01); *G04B 37/0075* (2013.01); *G04B 39/00* (2013.01)

(58) Field of Classification Search

CPC .... G04B 19/283; G04B 21/00; G04B 21/08; G04B 23/028; G04B 23/005; G04B 39/00

See application file for complete search history.

(56) References Cited

U.S. PATENT DOCUMENTS

| | | | | |
|---|---|---|---|---|
| 4,258,432 | A * | 3/1981 | Zafferri | G04C 21/02 368/250 |
| 4,271,498 | A * | 6/1981 | Zafferri | G04B 39/00 368/250 |
| 7,545,706 | B2 * | 6/2009 | Candaux | G04B 21/08 368/243 |
| 2010/0232262 | A1 | 9/2010 | Morata et al. | |
| 2011/0228647 | A1 * | 9/2011 | Karapatis | G04B 21/08 368/244 |
| 2012/0002513 | A1 * | 1/2012 | Behrend | G04B 37/052 368/286 |

FOREIGN PATENT DOCUMENTS

| | | |
|---|---|---|
| CH | 700 102 A2 | 6/2010 |
| CH | 706 079 B1 | 8/2013 |
| EP | 2 228 693 A1 | 9/2010 |
| WO | WO 00/36473 A1 | 6/2000 |

OTHER PUBLICATIONS

European Search Report issued Apr. 13, 2015 in European application 14187235, filed on Oct. 1, 2014 ( with English translation).

* cited by examiner

*Primary Examiner* — Vit W Miska

(74) *Attorney, Agent, or Firm* — Oblon, McClelland, Maier & Neustadt, L.L.P.

(57) ABSTRACT

Watch bezel for a musical watch, directly carrying a gong or forming a gong, this watch bezel including a toroid receiving a watch crystal, and a thin lug perpendicular to the plane of the toroid including an internal thread for securing to a structure, a case of the musical watch includes a case middle and carries this watch bezel indirectly bearing on a main surface of the case middle with a first O-ring sealing gasket, the case middle and the watch bezel are held securely to each other in a position where, in the free state of the watch bezel and with no excess pressure, the watch bezel is at a distance from the main surface having a value corresponding to a predetermined and non-zero play.

19 Claims, 2 Drawing Sheets

MUSICAL WATCH CASE WITH IMPROVED ACOUSTIC PERFORMANCE

This application claims priority form European Patent Application No. 14187235.8 filed on Oct. 1, 2014, the entire disclosure of which is hereby incorporated herein by reference.

FIELD OF THE INVENTION

The invention concerns a watch bezel for a musical watch including at least one gong arranged to vibrate and resonate as a result of an impact or bending, wherein said bezel is arranged to directly carry at least one said gong or forms at least one said gong.

The invention also concerns a crystal-bezel sub-assembly including a bezel of this type.

The invention further concerns a musical watch case including one such sub-assembly comprising at least one gong and including a case middle which includes a main receiving surface and a lower receiving surface.

The invention also concerns a musical watch including a case of this type.

The invention concerns the field of exterior watch parts, and more particularly, cases for movements comprising an audible display mechanism, such as a striking work, alarm, music box or similar.

BACKGROUND OF THE INVENTION

In a musical watch or striking watch, the sound level is a constant preoccupation, since it is necessary to produce a sound signal of sufficient intensity to be heard by the user while ensuring the purity of sound of this complication.

The sound level can be improved through the use of additional exterior elements. The frequency content of the sound produced by a striking watch must be rich in a frequency range between 1 kHz and 6 kHz.

Conventional exterior watch elements do not provide efficient radiation within this range, while higher frequency radiation, typically above 6 kHz, generally does not cause any problems.

A radiating element may be capable of radiating in the 1-6 kHz frequency range only if very strict geometric and dimensional constraints are observed, notably low rigidity and/or small thickness, or surfaces with pierced openings.

These constraints generally conflict with the rules of mechanical watch design, the object of which is to ensure impermeability, notably to dust and water, and the mechanical resistance of a watch to shocks and high external pressure, due, for example, to deep immersion, so as to ensure the maintenance and protection of the watch movement.

There are known solutions for integrating sound generating elements directly in external watch components, to facilitate the transmission of vibrations. However, these solutions provide only a small improvement if the external components are not free to vibrate in their natural modes.

EP Patent No 2367079B1 by the same Applicant describes a solution for allowing the crystal to vibrate freely in its natural vibration modes. This solution is acoustically effective, but difficult to produce and requires highly qualified personnel. The first (lowest frequency) vibrations of the crystal correspond to a dipole sound source, which is efficient mainly above 5 kHz.

CH Patent Application No 700102A2 in the name of FREDERIC PIGUET describes a watch case with a gong and gong holder directly integral with the case middle or back cover of the case.

WO Patent No 00/36473 in the name of Buenter-Sanz-Mulet describes a case including a sealed inner chamber containing the movement and the sound mechanism, and an outer chamber which includes an opening communicating with the exterior of the watch. These two chambers are separated by an water-resistant wall arranged to transmit the sound waves towards the outer chamber.

EP Patent Application No 2228693A1 in the name of Roth & Genta—BULGARI describes a gong holder secured to the crystal, through at least one hole in the crystal.

CH Patent No 706079B1 in the name of RICHEMONT describes an water-resistant case, a sound device with an oscillating assembly comprising a first vibrating member placed inside the water-resistant case, and an excitation mechanism for causing the first vibrating member to vibrate. The oscillating assembly includes a second vibrating member placed outside the water-resistant case and connected to the first vibrating member by a median portion of the oscillating assembly which passes through the water-resistant case, the vibration being transmitted from the first to the second vibrating member to emit a sound audible outside the water-resistant case.

SUMMARY OF THE INVENTION

The invention proposes to further improve frequency response.

The invention improves the sound level of a musical watch, notably in the frequency range from 1 to 6 kHz, while ensuring, on the one hand, a simple water-resistant assembly of the crystal-bezel system, and on the other hand, very good shock resistance. The invention proposes a mechanical system which allows an integrated sub-assembly, formed by the bezel and the upper crystal, to vibrate freely in its natural, acoustically effective modes.

To this end, the invention concerns a watch bezel for a musical watch including a least one gong according to claim 1.

The invention concerns another watch bezel for a musical watch including a least one gong according to claim 3.

The invention also concerns a crystal-bezel sub-assembly including one such bezel according to claim 13.

The invention also concerns a musical watch case according to claim 14.

The invention also concerns another musical watch case according to claim 15.

The invention also concerns a musical watch including a case of this type.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1A:
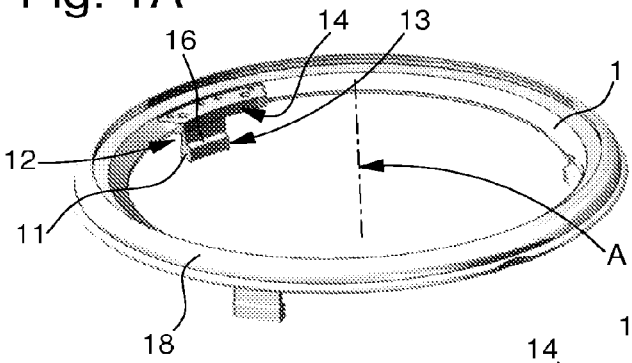
FIGS. 1A and 1B show schematic and perspective top and bottom views of a musical watch bezel according to the invention.
Figure 1B:
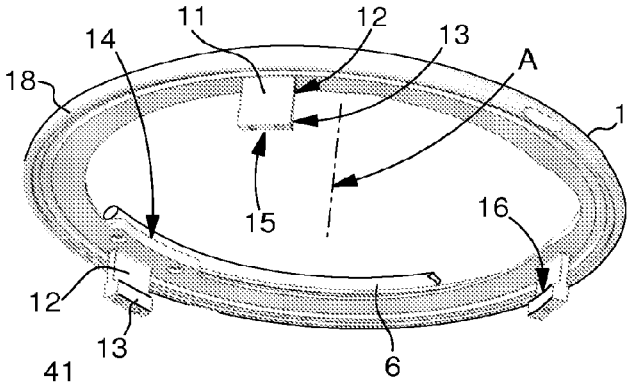

The invention concerns the field of exterior watch parts, and more particularly, cases for movements comprising an audible display mechanism, such as a striking work, alarm, music box or similar.

Hereafter "musical watch" refers to watches fitted with any type of audible display.

A "toroid" here is a closed, not necessarily regular, solid generated about an axis, and developed either side of a substantially plane or cylindrical or paraboloid or ellipsoid or hyperboloid or similar surface. Such a toroid may be formed by a ring, or by a volume of revolution or by a warped solid. The plane on which the projections of said toroid have the largest dimensions is called here the "toroid plane". Using the same logic, a "toric" surface is one that describes the revolution of such a toroid.

These audible mechanisms include one or more vibrating and resonant elements, such as gongs, bells, strips, vibration plates. The present specification uses the generic term "gong" for any such vibrating and resonating element arranged to vibrate and resonate as a result of an impact or bending.

In a conventional manner, a watch case 10 includes a case middle 4 which carries one or more gongs 6, a bezel 1 is assembled on case middle 4 and acts as support for a crystal 2 which transmits the sound vibration to the external medium.

The invention concerns a watch bezel 1 for a musical watch 100 including at least one gong 6. This bezel 1 is arranged to directly carry at least one such gong 6 or forms at least one such gong 6.

To improve acoustic performance, watch bezel 1 therefore directly carries at least one gong 6, and preferably all of gongs 6 forming the audible display means.

In a particular embodiment, the bezel is produced in one-piece with at least one gong. More specifically, bezel 1 is in one-piece with all the gongs 6 comprised in a musical watch 100.

In one embodiment specific to the invention, bezel 1 includes at least one flange 14 for directly securing a gong 6.

In a particular embodiment, and as illustrated in FIGS. 1A to 2C, bezel 1 includes a toroid 18 including a receiving surface 19 arranged to receive a watch crystal 2.

This toroid 18 includes at least one thin lug 11 which extends substantially perpendicularly to the plane of toroid 18 and on the side of toroid 18 opposite to the side carrying receiving surface 19.

More specifically, this at least one thin lug 11 is distinct from gong 6 and extends beyond toroid 18 in the axial direction of toroid 18.

This at least one lug 11 includes, at a solid distal end 13, at least one bearing face 15, particularly, but not restrictively, a distal bearing face, which is arranged to cooperate in abutment on a structure, notably a case middle 4, and securing means 17, such as an internal thread, arranged for rigid attachment of the at least one lug 11 via its at least one bearing face 15 on a structure. This rigid attachment is combined with pressing or clamping. In particular, such a lug 11 can be sandwiched laterally and held firmly in position. Securing means 17 are devised to cooperate with complementary securing means 47, such as a screw as seen in FIG. 2C.

More generally, this at least one lug 11 includes at least one abutment surface.

Preferably, bezel 1 includes a plurality of such lugs 11 extending in directions substantially parallel to each other and including parallel or coplanar bearing faces 15.

More specifically, the direction in which these lugs extend is parallel to a main axis of the watch case, which is in turn parallel to the main axis (main axis of the hands, or pivot axis of the oscillating weight) of the movement for which the watch case is designed.

In the particular and non-limiting variant illustrated by the Figures, bezel 1 includes three said lugs 11 extending in parallel directions to each other and including coplanar distal bearing faces 15.

Advantageously, each said lug 11 includes, between toroid 18 and its solid distal end 13, a thin median resilient strip 12, which is more flexible than solid distal end 13, this thin strip 12 extending in a substantially perpendicular direction to the plane of toroid 18.

Preferably, bezel 1 includes, on the side of toroid 18 opposite the side carrying receiving surface 19, a main bearing surface 150 which is arranged to cooperate in abutment with a structure, notably a case middle 4 and a toric groove 151 which houses a first O-ring sealing gasket 51.

This first O-ring sealing gasket 51 protrudes with respect to the main bearing surface 150 or is at least tangent therewith, on the side of toroid 18 opposite to the side carrying receiving surface 19, in every compressed position of O-ring sealing gasket 51.

In a variant, the first O-ring sealing gasket 51 is replaced or supplemented by an elastic membrane, or by a plate with holes of micrometric size.

Advantageously, the bezel is made of gold and/or platinum alloy. It may also be made of bronze, titanium alloy, or in some stainless steel grades.

The invention also concerns a crystal-bezel sub-assembly 3 including one such bezel 1. This crystal-bezel sub-assembly 3 includes a crystal 2 bearing on a receiving surface 19 comprised in bezel 1, and a second O-ring sealing gasket 52, or an elastic membrane, or a plate with holes of micrometric size, between bezel 1 and crystal 2, and this crystal-bezel sub-assembly 3 carries at least gong 6. This crystal-bezel sub-assembly 3 is completely independent, and only carries the radiating element.

The invention also concerns a musical watch case 10 including a least one gong 6 and including a case middle 4.

This case middle 4 includes a main receiving surface 40 and a lower receiving surface 45, which is arranged for to cooperate in abutment with the distal bearing surface or surfaces 15 of lugs 11.

Watch case 10 carries, either one such bezel 1 carrying at least one gong 6, or one such crystal-bezel sub-assembly 3, with bezel 1 indirectly bearing on the main receiving surface 40 by means of a first O-ring sealing gasket 51.

Case middle 4 and bezel 1 are held secured to each other by the cooperation of securing means 17 comprised in bezel 1 and complementary securing means 47 comprised in case middle 4, in a position where, in the free state of bezel 1 with no pressure other than atmospheric pressure, bezel 1 is at a distance from main receiving surface 40 having a value corresponding to a predetermined and non-zero play J.

Preferably, bezel 1 includes at least one such lug 11 and said lug 11 includes a thin median resilient strip 12.

Play J is calculated according to the maximum anticipated excess pressure on bezel 1, so that, in the event of maximum excess pressure on bezel 1 or in the event of a shock, each thin median strip 12 remains within the elastic deformation range, under the effect of direct abutment between bezel 1 and main receiving surface 40 when first O-ring sealing gasket 51 is completely compressed, thus preventing any irreversible elastic deformation of thin median strip 12.

The invention also concerns a musical watch 100 including a case 10 of this type.

In the proposed innovative design, upper crystal 2 is driven into bezel 1, or adhesive bonded to a receiving surface 19 of bezel 1, or welded, notably in a conventional manner. Bezel 1 is then screwed to case middle 4 by means of at least one lug 11. In the preferred embodiment illustrated by FIGS. 1A and 1B, the bezel includes three thin lugs 11. In a particular embodiment, the crystal-bezel sub-assembly 3 is in one piece. In a particular embodiment, crystal-bezel sub-assembly 3 is made of sapphire.

Compared to a conventional bezel-crystal system which is completely joined to the case by a connection over the entire periphery of the bezel, the attachment achieved by three thin lugs 11 is termed "dissociated" here, and makes it possible:

- to lower the natural frequencies of the secured mechanical bezel-crystal sub-assembly 3;
- to select almost monopolar natural vibration modes, i.e. corresponding to a consistent vibration over the entire surface of crystal 2.

The number, thickness, length and constituent materials of lugs 11s are parameters that make it possible to modify the effective radiation frequency range of the system.

In a particular embodiment, the largest dimension of each lug 11 is in the direction of the axis of toroid 18.

In a particular embodiment, each lug 11 has only substantially plane or plane surfaces.

In a particular embodiment, bezel 1 has a flange 14 on which is secured the gong 6, or the vibration generating element of a striking watch (for example, the gongs of a minute repeater or a vibration plate of a musical watch), which ensures optimum transfer of vibrations between the vibration source and the radiating element, without the attachment of the vibration source affecting the vibration modes of the bezel-crystal sub-assembly 3.

In fact, from the point of view of vibrations, the bezel-crystal sub-assembly 3 is virtually decoupled from the rest of the watch exterior, which thus remains virtually immobile during vibration of bezel-crystal sub-assembly 3.

Unlike a system with a radiating bezel or crystal or a conventional system, wherein the vibration is radiated only by vibration of the crystal, which thus has a dual role of reactance (return spring) and mechanical impedance (inertia), for the dissociated bezel-crystal sub-assembly 3 of the invention, the role of return spring is played by the thin lugs 11 securing bezel 1, while crystal 2 plays only the role of inertia for the mechanical system: its piston type motion creates a monopolar acoustic source and makes it possible to generate a very efficient sound wave in terms of sound perception.

Figure 2A:
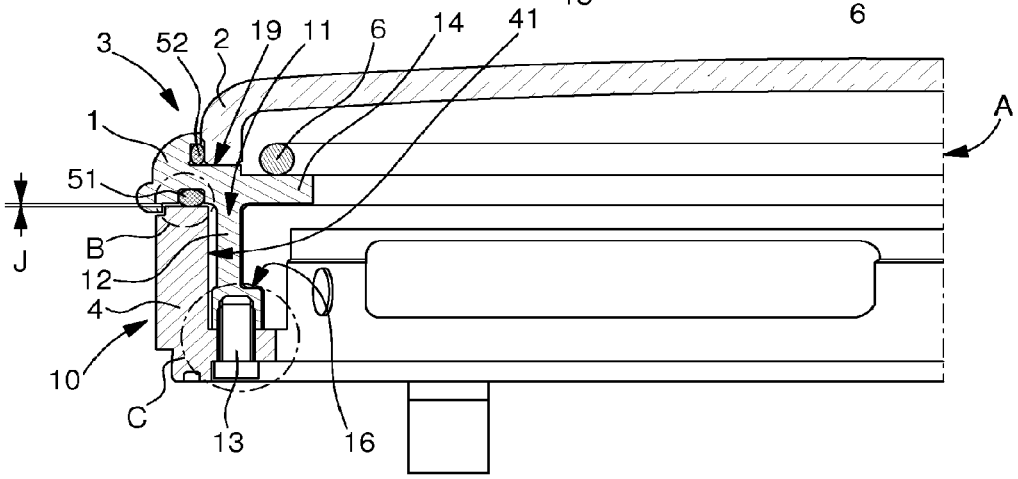
FIG. 2A shows a partial, schematic cross-sectional view, with two magnified details in FIGS. 2B and 2C, of a musical watch case including a crystal-bezel sub-assembly according to the invention.
Figure 2B:
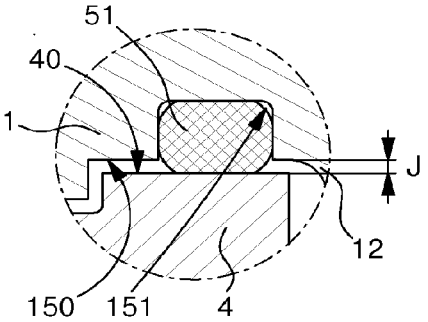
Figure 2C:
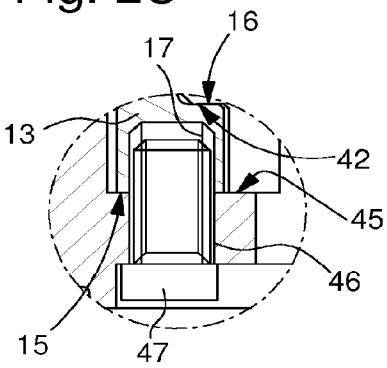

FIG. 2 shows the assembly of the so-called dissociated bezel 1 on case middle 4.

The play J between the bezel and case middle is an essential characteristic of the invention, and is necessary to ensure the complete mobility of bezel 1. Play J is also dimensioned so that, in the event of an extreme shock, bezel 1 presses on the periphery of case middle 4 to prevent thin lugs 11 deforming excessively and becoming plasticized.

For this design solution, impermeability is ensured to 3 bars, since the increase in external pressure increases the adhesion of the walls of bezel 1 and of case middle 4 of case 10 against the first O-ring sealing gasket 51.

Figure 3:
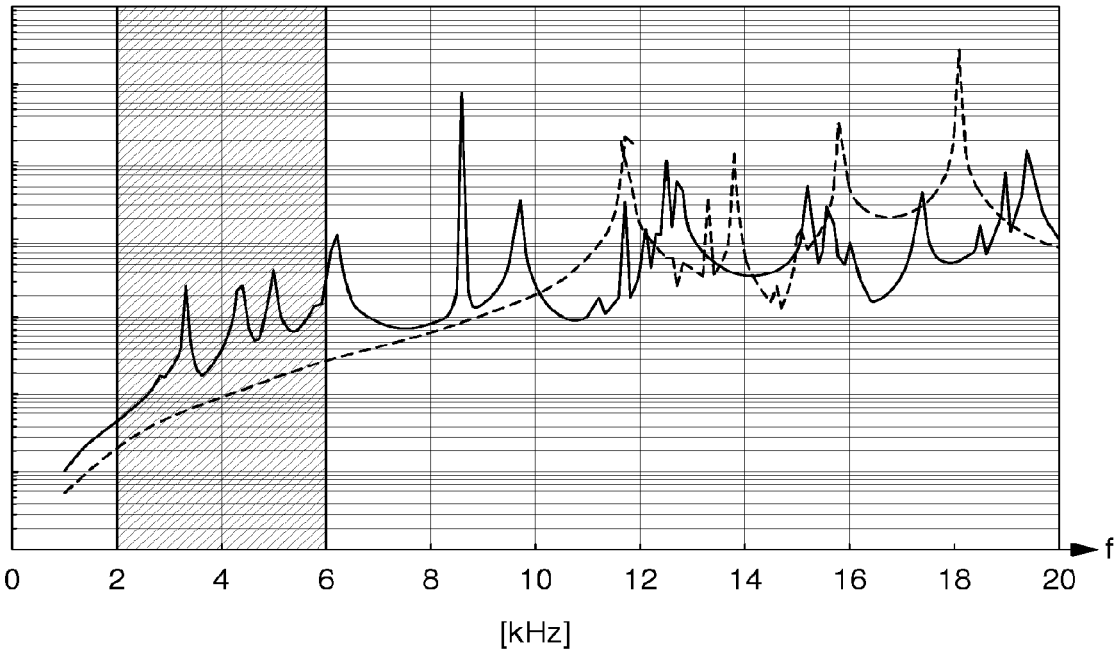
FIG. 3 is a diagram illustrating, as a function of frequency, on the abscissa, the axial acceleration of the crystal during a harmonic vibration, on the ordinate, for a watch exterior with a conventional bezel (dash line) and for the bezel-crystal system with the dissociated bezel according to the invention (solid line).
Figure 4:
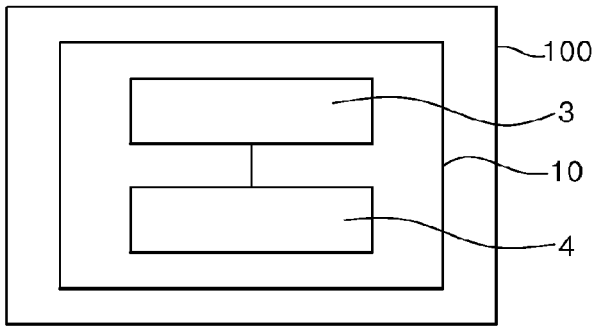
FIG. 4 is a block diagram showing a musical watch fitted with a case according to the invention.

FIG. 3 illustrates, as a function of frequency, the axial acceleration of crystal 2 during a simulated harmonic vibration for a watch exterior with a standard bezel (dash line) and for the bezel-crystal sub-assembly 3 with dissociated bezel 1 according to the invention (solid line).

Simulations with finished elements make it possible to dimension the secured mechanical bezel-crystal system and the transfer of vibrations between the system and the rest of the watch exterior FIG. 3 shows the frequency responses of the vibration acceleration (outside the plane of the watch) of two watch exteriors formed, on the one hand, by a dissociated bezel 1 (solid line) and, on the other hand, a standard bezel snap fitted on the case middle (dash line). The two watch exteriors are similar in terms of size and shock resistance. According to this graph, the first natural mode of a watch exterior formed of a standard bezel has a frequency of 12 kHz. The watch exterior formed of a dissociated bezel 1 has natural modes in the frequency range between 2 and 10 kHz and notably three frequencies where the sensitivity of the ear is maximum, above 2 kHz and below 6 kHz.

The watch exterior including a bezel-crystal sub-assembly 3 with dissociated bezel 1 has a higher vibration response than that of a standard watch exterior in the 2-10 kHz frequency range, which makes it possible to ensure efficient acoustic radiation of the striking work.

Further, the presence of several resonances (peaks) allows for simultaneous tuning of several partials of a gong or of several vibration plate strips. Conversely, this system vibrates less at frequencies above 13 kHz which is beneficial since the noise generated by the striking mechanism generally has broadband components at very high frequencies: the bezel-crystal system with a dissociated bezel is capable of filtering noise from the mechanism and preventing radiation.

The invention has numerous advantages:

- improvement of the sound level in the frequency range between 1 kHz and 6 kHz.
- possibility of defining the typology of the acoustic source, for example actuation of a quasi-monopolar sound source (vibration of the bezel-crystal in piston mode).
- multi-partial radiation.
- improvement of the transfer of vibrations between the vibration generating element and the radiating element. This solution makes it possible to secure the vibrating element directly on the radiating element, without affecting the vibration modes of the bezel-crystal.
- system able to preserve the impermeability of the musical watch and ensure sufficient mechanical strength to prevent deterioration of the striking movement under external pressure.
- possibility of decreasing the high frequency noise of the striking mechanism (above 13 kHz).
- possibility of one-piece manufacture.

What is claimed is:

1. A watch bezel for a musical watch including at least one gong arranged to vibrate and resonate as a result of an impact or bending, wherein said watch bezel is arranged to directly carry at least one said gong or forms at least one said gong, wherein said watch bezel includes at least one flange for direct attachment of a gong.

2. The watch bezel according to claim 1, wherein said watch bezel includes a toroid including a receiving surface arranged to receive a watch crystal and includes at least one thin lug separate from said gong and extending beyond said toroid in the axial direction of said toroid, and substantially perpendicular to the plane of said toroid and on the side of said toroid opposite to the side carrying said receiving surface, said at least one lug including, at a solid distal end, at least one bearing face arranged to cooperate in abutment on a structure, and securing means arranged for the rigid attachment of said at least one lug by said at least one bearing face thereof pressed or clamped onto a structure.

3. A watch bezel for a musical watch including at least one gong arranged to vibrate and resonate as a result of an impact or bending, wherein said watch bezel is arranged to directly carry at least one said gong or forms at least one said gong, wherein said watch bezel includes a toroid including a receiving surface arranged to receive a watch crystal and includes at least one thin lug separate from said gong and extending beyond said toroid in the axial direction of said toroid, and substantially perpendicular to the plane of said toroid and on the side of said toroid opposite to the side carrying said receiving surface, said at least one lug including, at a solid distal end, at least one bearing face arranged to cooperate in abutment on a structure, and securing means arranged for the rigid attachment of said at least one lug by said at least one bearing face thereof pressed or clamped onto a structure.

4. The watch bezel according to claim 3, wherein said watch bezel includes at least one flange for the direct attachment of a gong.

5. The watch bezel according to claim 3, wherein said watch bezel includes a plurality of said lugs extending in directions substantially parallel to each other and including said parallel or coplanar bearing faces.

6. The watch bezel according to claim 3, wherein the largest dimension of each said lug is in the direction of the axis of said toroid.

7. The watch bezel according to claim 3, wherein each said lug has only plane surfaces.

8. The watch bezel according to claim 3, wherein said watch bezel includes a three said lugs extending in directions parallel to each other and including said distal coplanar bearing faces.

9. The watch bezel according to claim 3, wherein each said lug includes, between said toroid and said solid distal end, a thin median resilient strip, which is more flexible than said solid distal end, said thin strip extending in a substantially perpendicular direction to the plane of said toroid.

10. The watch bezel according to claim 3, wherein said watch bezel includes, on the side of said toroid opposite to the side carrying said receiving surface, a main bearing surface arranged to cooperate in abutment with a structure, and a toric groove which houses a first O-ring sealing gasket, which protrudes with respect to said main bearing surface or is at least tangent therewith, on the side of said toroid opposite to the side carrying said receiving surface, in every compressed position of said first O-ring sealing gasket.

11. The watch bezel according to claim 1, wherein said watch bezel is made in one piece with at least one said gong.

12. The watch bezel according to claim 1, wherein said watch bezel is made of gold and/or platinum alloy.

13. A crystal-bezel assembly including a watch bezel according to claim 1, wherein said crystal-bezel sub-assembly includes a crystal bearing on a receiving surface comprised in said watch bezel, and a second O-ring sealing gasket between said watch bezel and said crystal, and wherein said crystal-bezel sub-assembly carries at least one gong.

14. A musical watch case including at least one gong and including a case middle which includes a main receiving surface and a lower receiving surface, wherein said watch case either carries a watch bezel according to claim 1 carrying at least one gong, or a crystal-bezel assembly wherein said crystal-bezel sub-assembly includes a crystal bearing on a receiving surface comprised in said watch bezel, and a second O-ring sealing gasket between said watch bezel and said crystal, and wherein said crystal-bezel sub-assembly carries at least one gong, with said watch bezel bearing indirectly on said main receiving surface by means of a first O-ring sealing gasket, and wherein said case middle and said watch bezel are held secured to each other by the cooperation of securing means comprised in said watch bezel and complementary securing means comprised in said case middle, in a position where, in the free state of said watch bezel and with no pressure other than atmospheric pressure, said watch bezel is at a distance from said main receiving surface having a value corresponding to a predetermined and non-zero play.

15. A musical watch case including at least one gong and including a case middle which includes a main receiving surface and a lower receiving surface, wherein said watch case either carries a watch bezel according to claim 3 carrying at least one gong, or a crystal-bezel assembly wherein said crystal-bezel sub-assembly includes a crystal bearing on a receiving surface comprised in said watch bezel, and a second O-ring sealing gasket between said watch bezel and said crystal, and wherein said crystal-bezel sub-assembly carries at least one gong, with said watch bezel bearing indirectly on said main receiving surface by means of a first O-ring sealing gasket, and wherein said case middle and said watch bezel are held secured to each other by the cooperation of securing means comprised in said watch bezel and complementary securing means comprised in said case middle, in a position where, in the free state of said watch bezel and with no pressure other than atmospheric pressure, said watch bezel is at a distance from said main receiving surface having a value corresponding to a predetermined and non-zero play.

16. The musical watch case according to claim 14, wherein said watch bezel includes at least one lug, said lug includes a thin median resilient strip, and wherein said play is calculated as a function of the maximum anticipated excess pressure on said watch bezel so that, in the event of maximum excess pressure on said watch bezel or in the event of a shock, each said thin median strip remains within the elastic deformation range, under the effect of direct abutment between said watch bezel and said main receiving surface when said first O-ring sealing gasket is completely compressed, preventing any irreversible plastic deformation of said thin median strip.

17. The musical watch case according to claim 15, wherein said watch bezel includes at least one lug, said lug includes a thin median resilient strip, and wherein said play is calculated as a function of the maximum anticipated excess pressure on said watch bezel so that, in the event of maximum excess pressure on said watch bezel or in the event of a shock, each said thin median strip remains within the elastic deformation range, under the effect of direct abutment between said watch bezel and said main receiving surface when said first O-ring sealing gasket is completely compressed, preventing any irreversible plastic deformation of said thin median strip.

18. The musical watch case according to claim 14, wherein said watch bezel is made in one piece with all the gongs comprised in said musical watch.

19. A musical watch including one said musical watch case according to claim 14.

* * * * *